US005919051A

United States Patent [19]

Mitra

[11] Patent Number: 5,919,051

[45] Date of Patent: Jul. 6, 1999

[54] FLAT BACK CARD CONNECTOR

[75] Inventor: Niranjan Kumar Mitra, Eindhoven, Netherlands

[73] Assignee: BERG Technology, Inc., Reno, Nev.

[21] Appl. No.: 08/921,214

[22] Filed: Aug. 27, 1997

Related U.S. Application Data

[62] Division of application No. 08/362,510, filed as application No. PCT/US93/06677, Jul. 16, 1993, Pat. No. 5,685,726.

[30] Foreign Application Priority Data

Jul. 7, 1992 [JP] Japan ..... 4-50219
Dec. 24, 1992 [NL] Netherlands ..... 9202262

[51] Int. Cl.[6] ..... H01R 9/09

[52] U.S. Cl. ..... 439/74

[58] Field of Search ..... 439/74, 78, 83, 439/81, 552–558, 855, 862

[56] References Cited

U.S. PATENT DOCUMENTS

| | | | |
|---|---|---|---|
| 3,116,960 | 1/1964 | Olsson et al. | 439/552 |
| 3,652,899 | 3/1972 | Henschen | 317/101 DH |
| 3,745,510 | 7/1973 | Mallon | 439/552 |
| 3,951,494 | 4/1976 | Romine | 439/81 |
| 4,004,845 | 1/1977 | Sochor | 439/891 |
| 4,232,923 | 11/1980 | Otsuki et al. | 339/17 LC |
| 4,479,686 | 10/1984 | Hoshino et al. | 339/17 LC |
| 4,620,766 | 11/1986 | Leonard | 439/748 |
| 4,909,746 | 3/1990 | Scholz | 439/82 |
| 4,934,945 | 6/1990 | Nakamura | 439/75 |
| 5,145,384 | 9/1992 | Asakawa et al. | 439/78 |
| 5,169,322 | 12/1992 | Frantz et al. | 439/83 |
| 5,188,535 | 2/1993 | Bertho et al. | 439/83 |
| 5,197,891 | 3/1993 | Tanigawa et al. | 439/83 |
| 5,200,884 | 4/1993 | Ohashi | 361/401 |
| 5,281,160 | 1/1994 | Walkup et al. | 439/266 |
| 5,556,285 | 9/1996 | Ono | 439/74 |

FOREIGN PATENT DOCUMENTS

| | | |
|---|---|---|
| 0 538 029 A2 | 4/1993 | European Pat. Off. . |
| 2368852 | 5/1978 | France . |
| 3243437 A1 | 6/1983 | Germany . |
| 8630057 | 1/1987 | Germany . |
| 1467382 | 3/1977 | United Kingdom . |

OTHER PUBLICATIONS

©IBM Corporation, "Gull Wing–Type Pin Header", *IBM® Technical Disclosure Bulletin,* Dec. 1992, 35(7), 61–62.

Tanaka, K., "Board–to–Board Connectors Increasingly Used for Consumer Products", *Jee J. Electr. Engineer.,* Feb. 1988, 25(254), 30–35.

*Primary Examiner*—Neil Abrams
*Attorney, Agent, or Firm*—Woodcock Washburn Kurtz Mackiewicz & Norris LLP

[57] ABSTRACT

A low profile electrical connector system for electrically coupling substrates (30, 31, 86, 97). The connector system comprises first and second connectors (2,1), each adapted for association with a substrate (30, 31, 86, 97). The first connector (2) comprises a plurality of male contact elements (44, 84, 96) arranged to extend perpendicular to the first substrate. The second connector (1) having a housing (5) with a planar upper wall having holes (52) for providing access to female contact elements (3) adapted to engage the male contact elements (44, 84, 96).

23 Claims, 10 Drawing Sheets

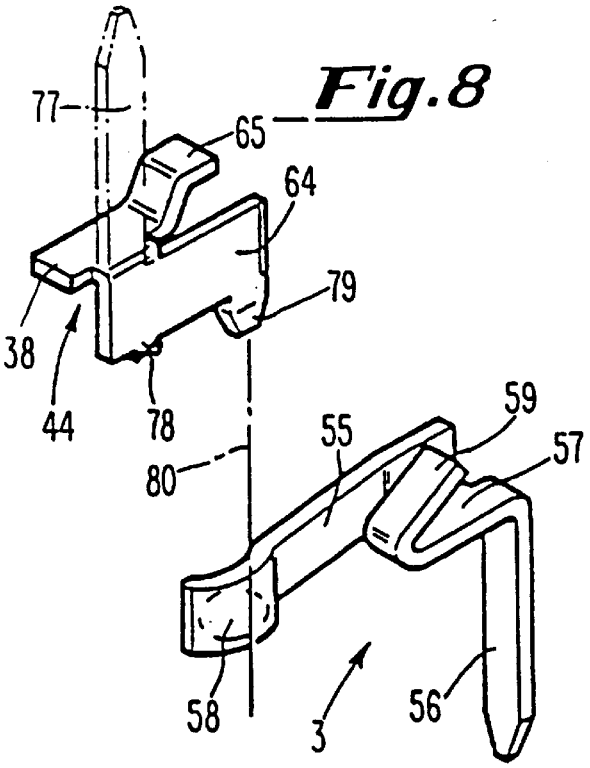
Fig. 8
Fig. 9
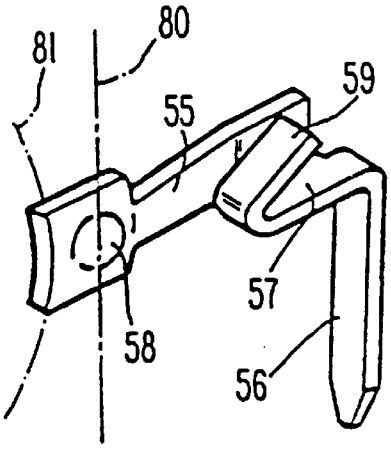
Fig. 10
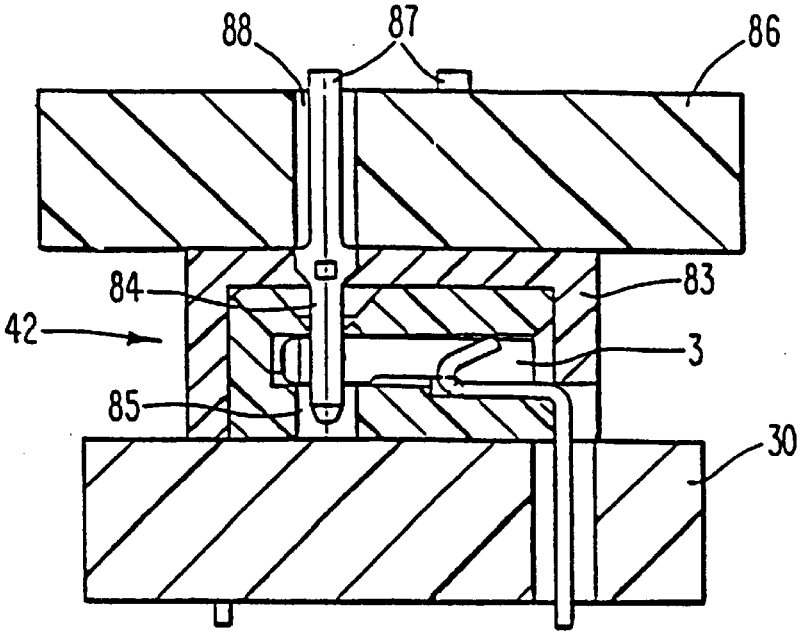
Fig. 11

FLAT BACK CARD CONNECTOR

CROSS-REFERENCE TO RELATED APPLICATIONS

This application is a Divisional application of Ser. No. 08/08/362,510 filed Jul. 27, 1995 now issued U.S. Pat. No. 5,685,726 which is a National Phase of PCT/US93/06677 filed Jul. 16, 1993 claiming priority to Japan Application SN 450219 filed Jul. 7, 1992 and Netherlands Application SN 9202262 filed on Dec. 24, 1992.

FIELD OF THE INVENTION

The present invention relates to a card connector for connecting boards. In particular, the invention relates to a card connector which has a reduced height or low profile over a circuit board when it is mounted on the circuit board.

BACKGROUND OF THE INVENTION

In the past, card connectors for connecting a mother board and a daughter board have been mounted on one surface of the mother board, with solder tails of the card connector soldered to solder pads on the same side of the mother board. Although various electronic component parts are also mounted on one surface of the mother board, the connection terminals of the electronic components are soldered on the other surface of the mother board via holes in the mother board.

Recently there has been growing demand for automating a soldering step for a board-to-board interconnect system. In this regard, it is desirable to achieve one step soldering of a card connector. In the aforementioned mount method, since the card connector and electronic component parts are soldered on the opposite sides of the mother board, the card connector and other electronic components cannot be soldered with one step.

Further, there is also a growing demand for a board-to-board interconnect system with a connector which extends only a short distance above the board surface. This demand stems, in part, from efforts to scale down or miniaturize electronic components and to achieve high component density. In the aforementioned mount method, since the card connector is mounted and soldered on the same surface of the mother board, there is an undesirable height of the card connector above the surface of the mother board. A need therefore exists to reduce the height of the card connector, i.e. a low profile connector.

In mounting the card connector, it is also necessary to change the existing mount method and to automate the soldering step.

SUMMARY OF THE INVENTION

In order to satisfy the aforementioned demands, a card connector is provided according to the present invention whereby it is possible to automate a soldering step during assembly while ensuring the minimal height of the card connector.

According to the present invention, a card connector is provided which connects a first and second boards. The first board has both a primary side and a solder side and a opening connecting the primary side to the solder side. The second board has contact pins. The aforementioned card connector has an elongated housing made of an insulating resin and fits in the opening of the first board. The card connector also has recesses which hold a plurality of contact terminals and receive the contact pins of the second board in the recesses. Each contact terminal has one end which is in contact with the contact pins of the second board. The other end of the contact terminal faces the solder side of the first board and is soldered to the solder side of the first board.

The housing further comprises first projections to contact the primary side of the first board and second projections to contact the solder side of the first board. The first board is held between the first and second projections. Hence, the housing is held in place with respect to the first board.

According to the card connector of the present invention, the housing is inserted into the opening of the first board, and the solder tail of each contact terminal is soldered to the solder side of the first board. As a result, it is possible to reduce the height of the housing which extends over the primary side of the first board. It is also possible to achieve the soldering of the solder tail of each contact terminal to an associated electronic component on the same side of the first board.

Since the first board is held by the first and second projections of the housing, the housing is held in place with respect to the first board. Even when the first board is inverted, the housing is kept in the position.

The second projections of the housing serve as a stopper whereby the housing is prevented from being over inserted into the opening on the first board beyond a necessary extent.

BRIEF DESCRIPTION OF THE DRAWINGS

FIG. 7A shows that the connector assembly is disassembled while FIG. 7B shows the assembled connector assembly.

FIG. 8 schematically shows a perspective view of a male contact element for use in a male-type-connector according to the invention.

FIGS. 9 and 10 schematically show various embodiments of a female contact element for use in a female-type connector according to the invention.

FIG. 11 schematically shows a cross-sectional view of the contact element shown in FIG. 7 in the contacted state with a pin-shaped male contact element.

DETAILED DESCRIPTION OF THE PREFERRED EMBODIMENTS

Figure 1:
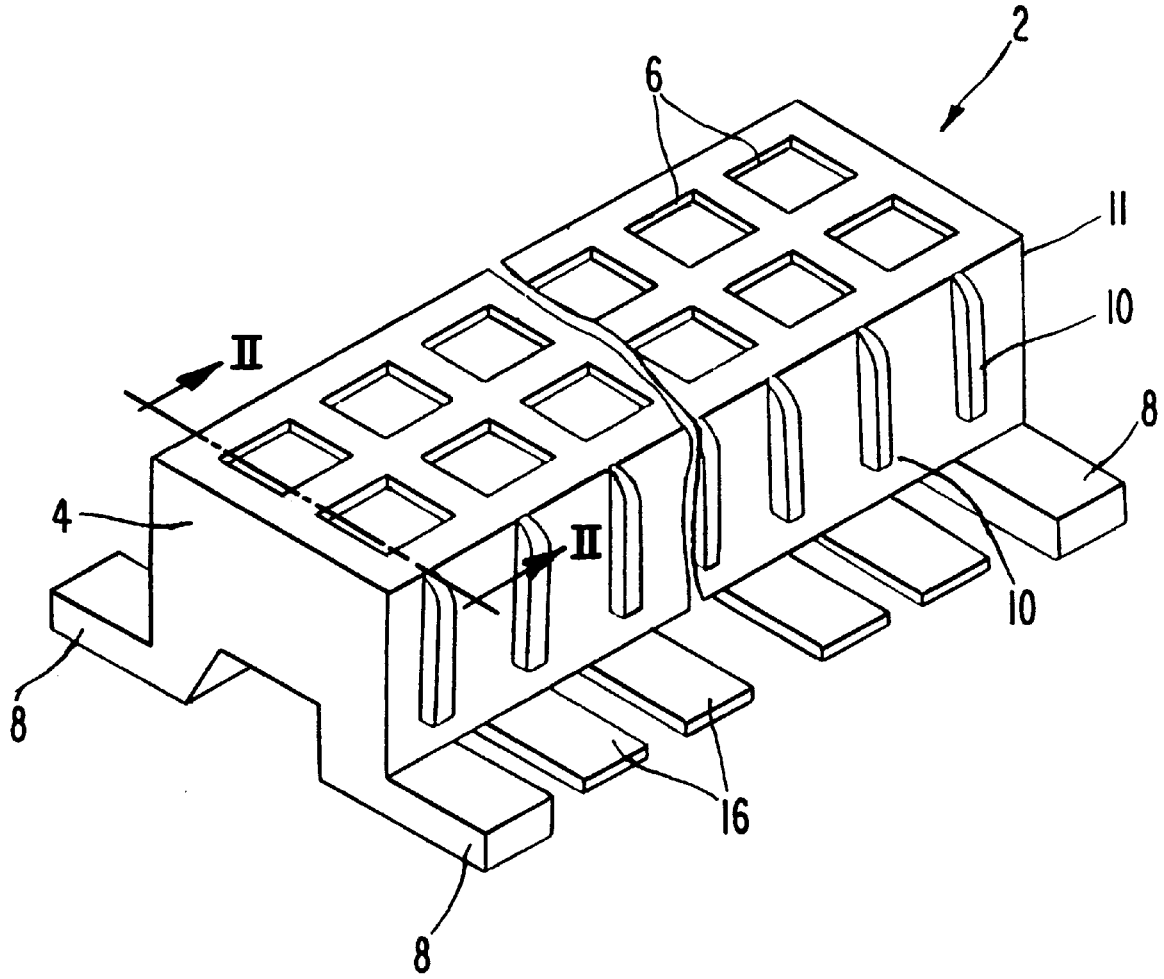
FIG. 1 shows a perspective view of a card connector according to one embodiment of the present invention.

FIG. 1 shows one embodiment of a low profile connector constructed in accordance with the present invention. A card connector 2 makes a connection between a mother board and a daughter board. The card connector 2 includes an elongated housing 4 which is made of an insulating resin and slots 6 which are provided at the upper surface of the housing to receive connection pins of the daughter board. A stopper 8 is provided at each of the bottom corners of the elongated housing 4. These stoppers 8 extend from a lateral wall 11 of the housing 4 in a perpendicular direction. The stoppers 8 can be separately molded and attached to the housing 4 or molded integral with the housing 4. Holding rips 10 are also provided in an array on the lateral wall 11 of the elongated housing 4 and extend from the top edge toward the bottom edge of the housing. However, the lower end of each rip 10 terminates short of the bottom edge of the housing 4.

Figure 2:
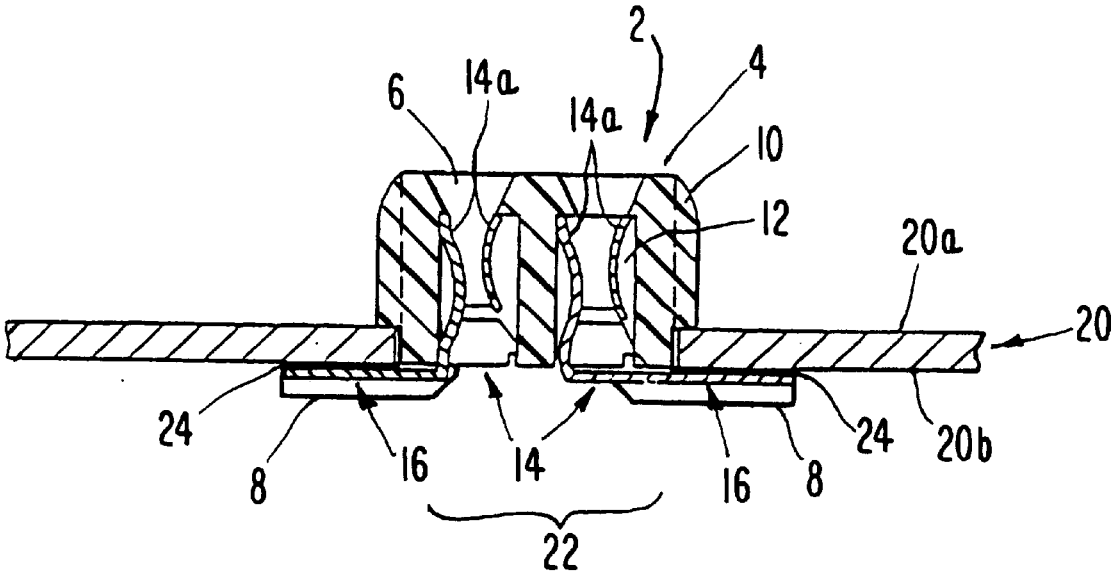
FIG. 2 shows a cross-sectional view of the card connector together with a mother board as shown in FIG. 1 at II—II.

FIG. 2 shows a cross sectional view of the housing 4 at FIG. I at II—II. A recess 12 is continuous with a corresponding slot 6 in the housing 4. Contact terminals 14 are arranged in two arrays in a longitudinal direction of the housing 4. One end 14*a* of each contact terminal 14 is placed in the corresponding slot 6 and electrically connectable to an associated contact pin. A solder tail 16 is provided at the other end of the respective contact terminal 14 and extends along the solder side surface 20*b* of the mother board 20 in a substantially parallel relation to the stopper 8.

A mount opening 22 is provided on the mother board 20 and is substantially equal in size to the bottom area of the housing 4 so as to allow the housing 4 to be mounted therein. Solder pads 24 each corresponding to the solder tail 16 are provided on the solder side 20*b* of the mother board 20 near the mount opening 22. Each solder pad is placed between the solder tail 16 and the solder side 20*b* of the mother board 20.

Figure 3:
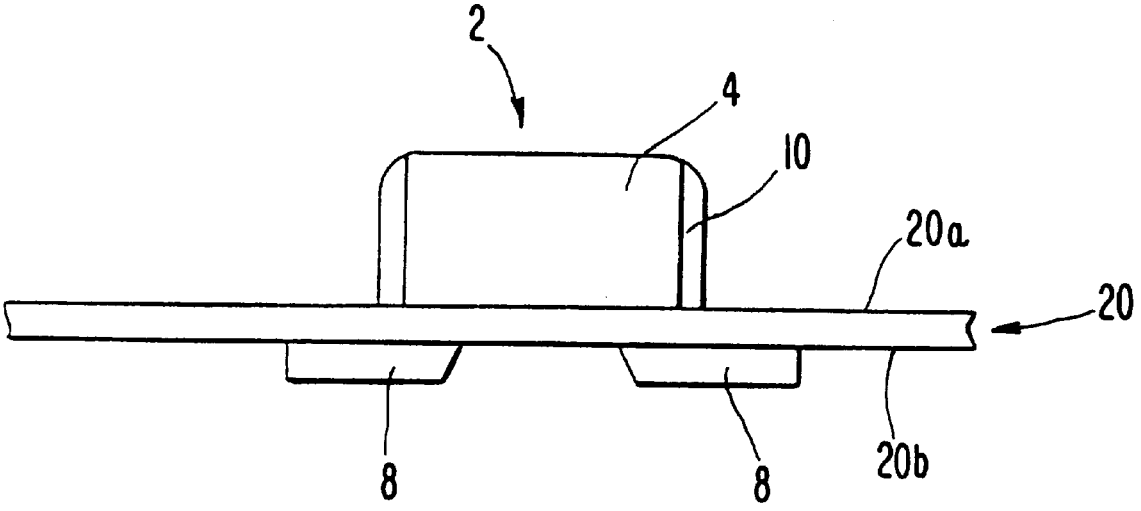
FIG. 3 shows a side view of the card connector together with the mother board as shown in FIG. 1.

When the housing 4 is placed into the mount opening 22 from the solder side 20*b* of the mother board 20, the ribs 10 are elastically deformed toward the center of the housing 4 so that the housing 4 is fitted through the opening 22. With the housing 4 fully fitted into the opening 22, a substantial portion of the housing 4 is projected out on a primary or front side 20*a* of the mother board 20. The ribs 10 fully extend to return to an initial state after the housing 4 is placed in the mounting opening 22. In this state, the stoppers 8 extend along the solder side 20*b* of the mother board 20 with the ribs 10 abutting to the primary side 20*a* of the mother board 20 as shown in FIG. 3. The mother board is held between the stoppers 8 and ribs 10 of the housing 4 so that the housing 4 is held in place with respect to the mother board 20.

Further, the stopper 8 is set in contact with the solder side 20*b* of the mother board 20 to prevent any excess insertion of the housing 4 into the opening 22 of the mother board 20. The stopper 8 also ensures a proper horizontal seating of the housing 4 with respect to the mother board 20. Thus, the solder tail 16 is prevented from being deformed by the excess insertion of the housing 4, and the solder tail 16 is kept in close contact with the associated solder pad 24.

In a conventional method for mounting a card connector, the solder tail of a card connector is soldered to the primary surface side of the mother board. On the other hand, the solder tail 16 is soldered to the solder side 20*b* of the mother board 20 according to a present method and apparatus of the current invention as shown in FIG. 2. The height of the housing 4 which extends over the primary side 20*a* of the mother board 20 is reduced at least by the thickness of the mother board 20. It is, therefore, possible to achieve a card connector 2 of a reduced height.

Since the card connector 2 is held in place relative to the mother board 20 by the stoppers 8 and ribs 10, when the mother board 20 is inverted prior to a solder reflow process, the card connector 2 remains in the same position with respect to the mother board 20. With the other board 20 inverted, that is, when the solder side 20*b* of the mother board is placed upside down, the card connector 2 and other electronic components on the same mother board 20 are soldered in one step by an infrared solder reflow process.

Figure 4:
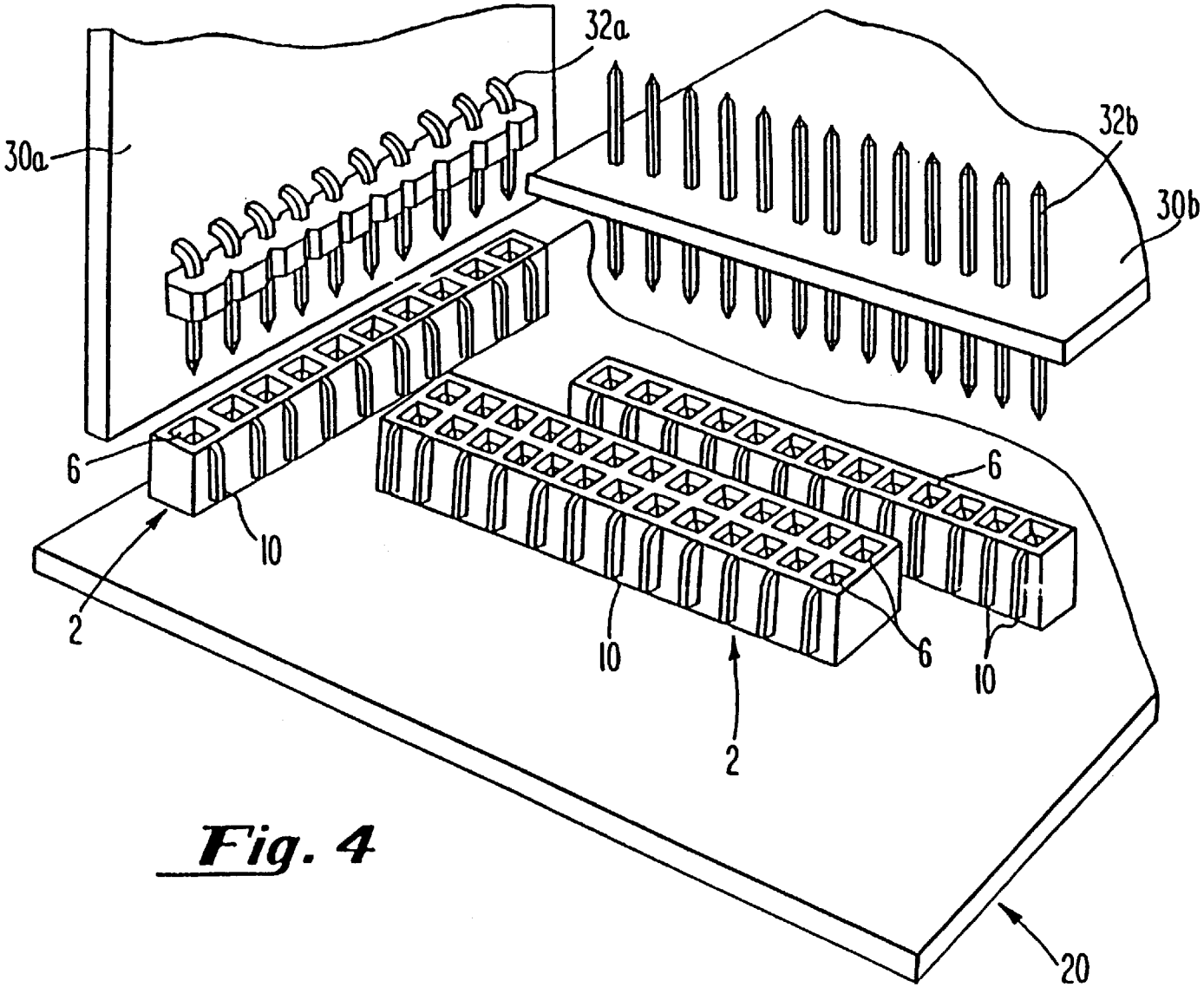
FIG. 4 shows a perspective view of a board-to-board interconnect system using the card connector of the present invention.

FIG. 4 shows a board-to-board interconnect system using those card connectors 2 according to the present invention. The daughter board may be connected to the mother board 20 in a vertical plane as shown by 30*a* or in a horizontal plane as shown by 30*b*. Either bent or straight connect pins on the daughter board may be inserted into the associated slots 6 of the card connector 2. Further, the slots 6 of the card connector 2 may be provided not only in two arrays but also in three arrays.

Figure 5A:
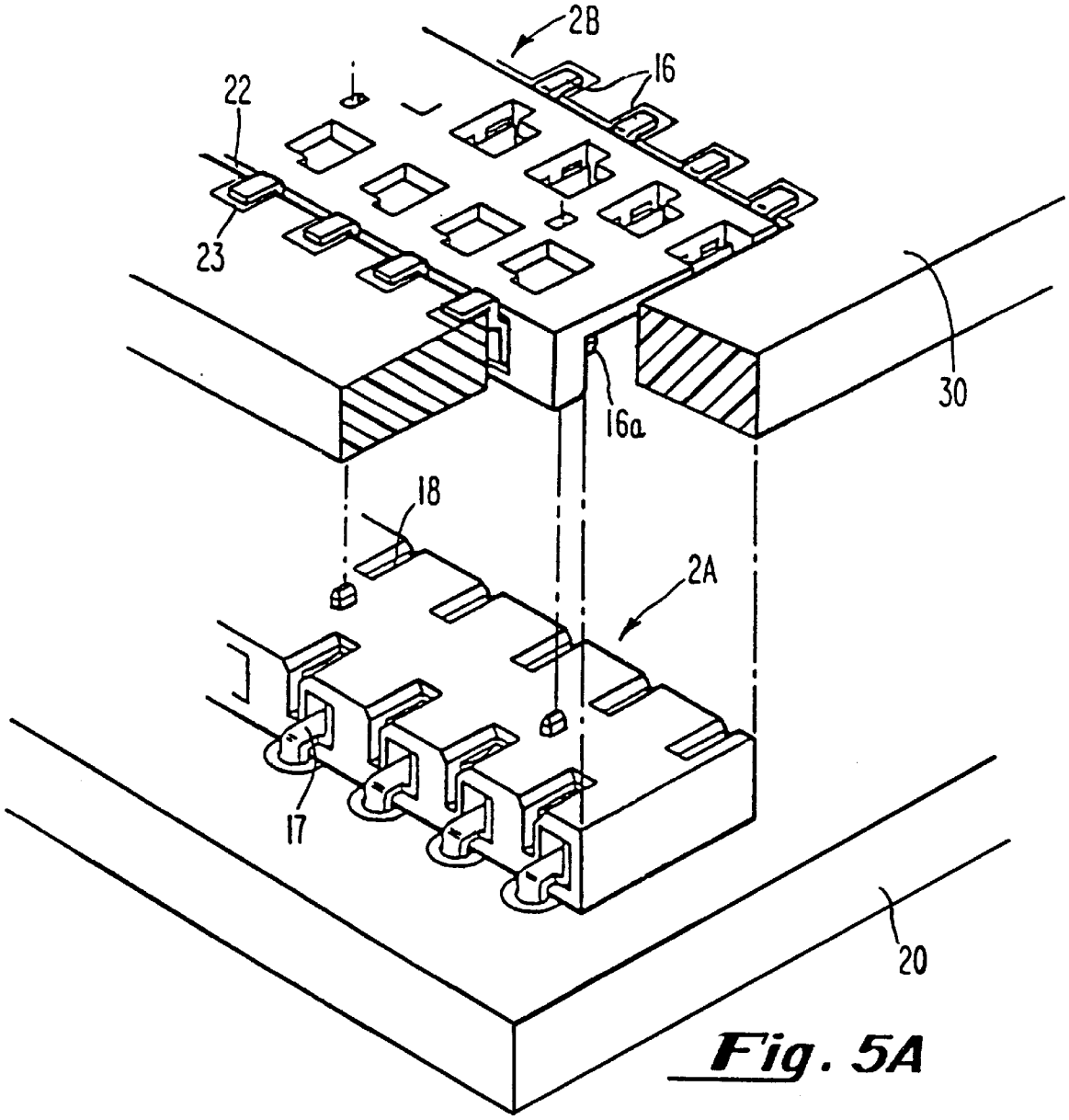
FIGS. 5A and 5B show another embodiment of a board-to-board interconnect system using a male card connector that is buried in a second board.
Figure 5B:
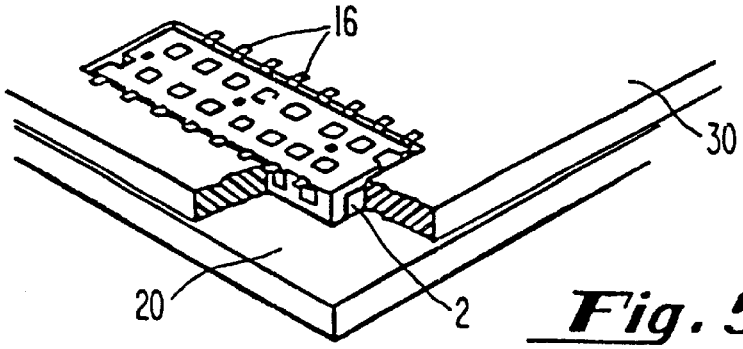
Figure 5C:
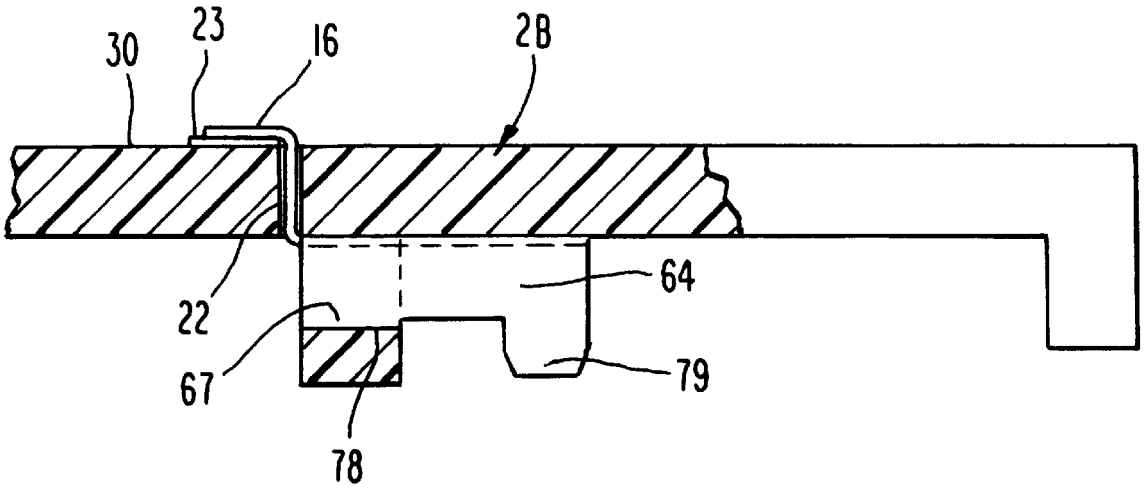
FIG. 5C shows a cut-away side view of a male connector portion of the interconnect system of FIGS. 5A and 5B.

FIGS. 5A and 5B show another embodiment of a low profile connector constructed in accordance with the invention. In FIG. 5A, a card connector 2B of the current invention is placed in an upper circuit board 30. The reverse U-shape connector 2B has a height that is approximately equal to the width of the upper circuit board 30. Thus, when the card connector 2B is placed in a bore 22 of the upper circuit board 30, the top and bottom of the connector 2B are respectively leveled with the top and bottom surfaces of the upper circuit board 30. According to this embodiment, solder tails 16 are disposed on the top surface of the upper circuit board 30 to make contact with elements on the upper circuit board 30. The solder tails 16 are connected by reason of surface mounting mechanisms by soldering or, for example, with the aid of electrically connecting glue to patches 23 on paper circuit board 30. FIG. 5A also shows a lower circuit board 20 and a corresponding connector 2A, which is connected to the lower circuit board 20. The connector 2A has the outer dimension of a narrower width and approximately the same length as that of the connector 2B.

FIG. 5B shows a prospective view of the two circuit boards 20, 30 of FIG. 5A placed on top of each other. Accordingly, the card connectors 2A and 2B are latched into a single rectangular unit. The contact portion 16*a* of the solder tail 16 of the upper card connector 2B is inserted in a recess 18 of the lower card connector 2A and makes a contact with a lower contact surface 17. As a result, the space between upper circuit board 30 and lower circuit board 20 is virtually eliminated when the two circuit boards are connected via the card connectors 2A and 2B as shown in FIG. 5B.

According to a card connector of the present invention, since the solder tails of the contact terminals are soldered to the solder side of the first board (mother board) even though the card connector is mounted on the primary side of the first board, it is possible to achieve card connectors with a substantially low profile.

Even if the first board is inverted, the card connector remains in the latched position with respect to the first board. This allows an automated solder process for soldering both components and connectors on the board.

Figure 6:
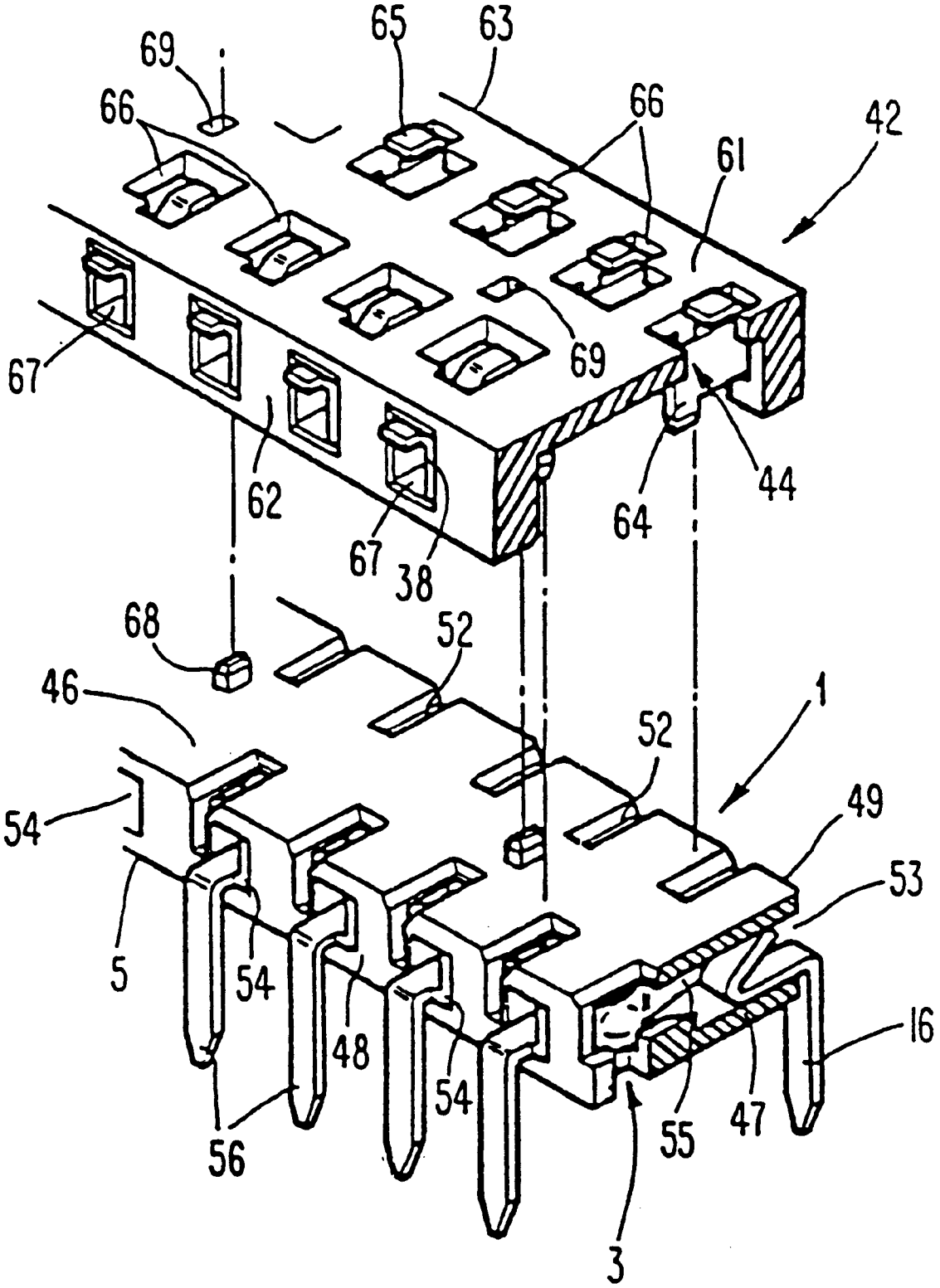
FIG. 6 schematically shows a perspective and partly in cross-sectional view of a female-type connector and a male-type connector according to the invention.

FIG. 6 shows part of a female-type connector 1 and part of a male-type connector 42 according to another alternate embodiment of a low profile connector constructed in accordance with the invention. The two connectors 1, 42 are elongate and provided with a plurality of female-type contact elements 3 ("socket contact elements") and male-type contact elements 44 ("plug contact elements") arranged adjacently in a longitudinal direction of the connectors 1, 42.

Figure 7A:
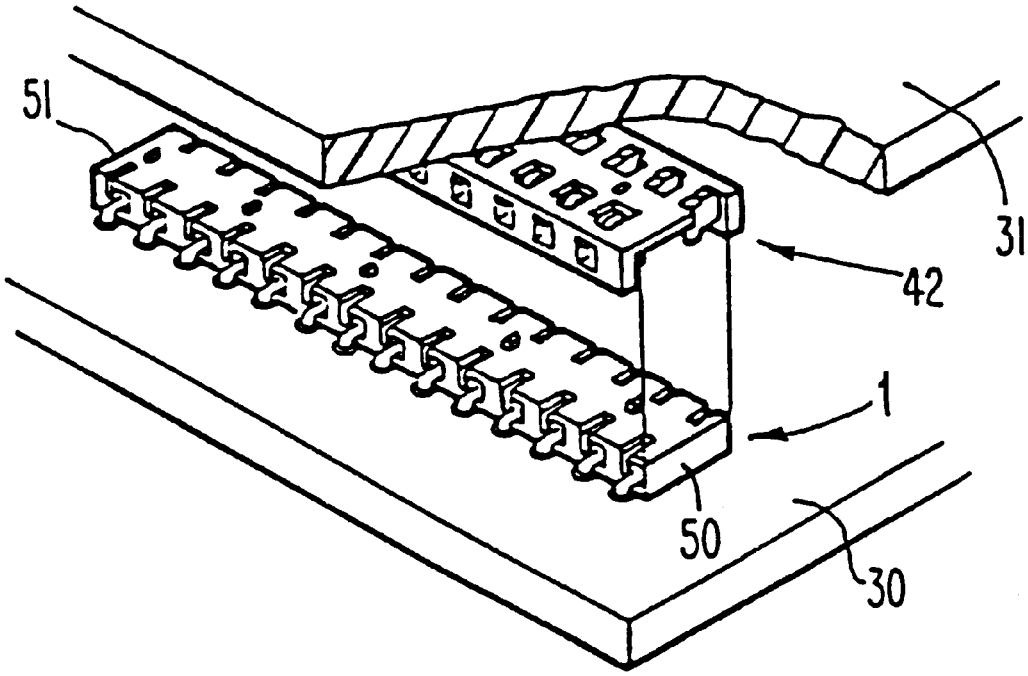
FIGS. 7A and 7B schematically show perspective and partly cross-sectional view of the connector assembly according to FIG. 6, which is mounted on printed circuit boards.

The female-type connector 1 comprises an essentially rectangular housing 5 of electrically insulating material, for example plastic, with a top wall 46, a bottom wall 47, side walls 48, 49 and end walls 50, 51, which are not visible in FIG. 6 (see FIG. 7A). The top wall 46 is provided with slot-shaped contact holes 52, which partially extend into the adjoining side walls 48, 49. The contact holes 12 are connected to rectangular, elongate channels 53 formed in the housing 45. In the embodiment shown, said channels 53 alternately open, in the side walls 48, 49, into a hole 54 for the purpose of inserting a contact element 3 into a channel 53.

The female-type contact elements 3 are provided with finger-shaped contact ends 55 which extend in a channel 53 of the housing 5, and with a connection end 56, which projects outside the housing 5 and which is made of electrically conductive material. The free ends of the contact ends 55 are positioned opposite the contact hole 52 connecting to the channel 53 in question, and in the direction transverse to the top wall 46.

The male-type connector 42 likewise has an essentially rectangular housing 40 of electrically insulating material, such as plastic, with a top wall 61 and two side walls 62, 63 adjoining thereto. As can be clearly seen from FIG. 6, the housing 60 has an essentially U-shaped cross-section. The internal spacing between the side walls is chosen so as to be able to place the housing 60 over the housing 5. The male-type contact elements 44 have plate-shaped, rectangular contact ends 64 made of electrically conductive material, which extend transversely to the top wall 61 as well as transversely to the side walls 62, 63 between the latter. The top wall 21 of the housing 60 is provided with holes 66, via which the connections ends 65 of the contact elements 44 project outside the housing, for the purpose of connecting the contact elements to a substrate. Via these holes 66, a visual inspection is also possible of the connection of the connection ends 65 to the substrate 31 (see FIG. 7A). In order to retain the male contact elements 44 in the housing 60, cut-outs 67 are arranged in the side walls 62, 63 for the purpose of receiving and supporting the contact elements.

FIG. 7A shows the connectors 1, 42 mounted on a substrate 30 and 31 respectively, such as, for example, a printed circuit board, which may be fitted with electronic components (not shown).

In the contacted state of the two connectors 1, 42 as shown in FIG. 73, the housing 60 of the male connector 42 encompasses the housing 5 of the female connector 1, in such a way that the male contact elements 44, via the contact holes 52, make electrical contact with the female contact elements 3. In order to achieve correct mutual positioning of the two connectors, to prevent damage on the one hand and incorrect or unwanted contact connections on the other hand, the top wall 46 of the female connector 1 is provided with positioning or polarizing studs 68 projecting outward, which in the contacted state of the connector assembly engage in suitably positioned and dimensioned positioning or polarizing holes 69, respectively. The studs 68 and holes 69 may be interchanged with regard to position and/or may have different shapes and positions, depending on, for example, a specific application.

Figure 7B:
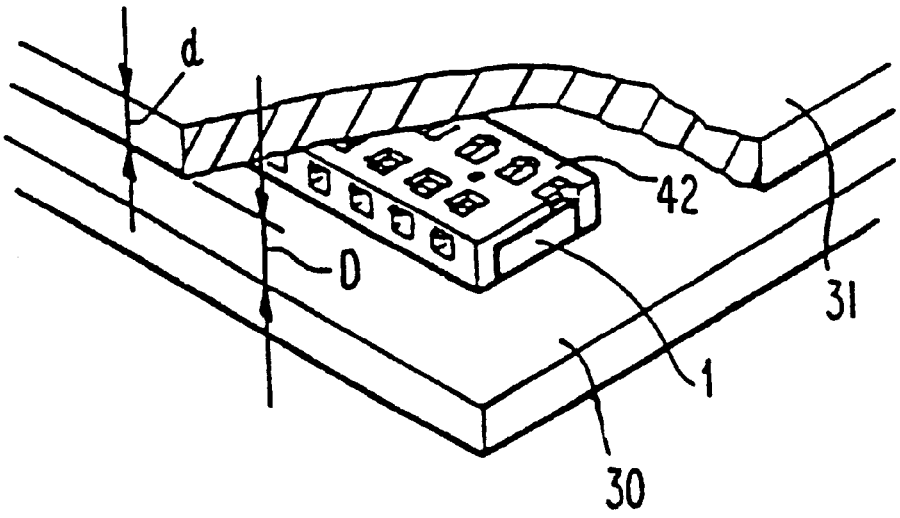

It can be clearly seen from FIG. 7B that the substrates 30, 31 can be contacted, by means of the relevant connector assembly according to the invention, with a gap D between them, which is approximately equal to the substrate thickness d.

The embodiment of the invention particularly shown in FIGS. 6, 7A and 7B are preferably constructed with contacts of the type shown in FIGS. 8, 9, 10 and 12*a,* b and c. FIG. 8 shows, by unbroken lines, the-male contact element 44 used in the male connector 42 shown in FIG. 6.

As already described, the contact end of the male contact element 44 comprises a plate-shaped, approximately rectangular part having a connection end 65 for surface-mounting technique. Instead of a connection end 65 for surface mounting, the male contact element may alternatively be provided with a pin-shaped connection end 77, shown by broken lines, for the purpose of pin/hole solder mounting on a substrate.

To facilitate the insertion of the contact end 64 into a contact hole, the rectangular plate part is provided with a tongue 79 which projects in the plane thereof. Said tongue 79 achieves mechanical guidance of the male contact element 44 when contacting a female contact element, for example the female contact element 3 shown in FIG. 9, as illustrated by the dot-and-dash line 80. The tongue 79 furthermore results in a cleaning effect on the contact sites 58 of the female contact elements ("wiping"). Contamination, corrosion or other deposits on the contact sites 58 are wiped away by the tongue 79 upon insertion, before the actual electrical contact between the contact elements is accomplished.

In order to retain the male contact element 44 in the housing 60, the contact end 64 is provided with a retention hook 38 which, in the mounted state, engages a side wall 62, 63 of the housing in a cut-out 67 thereof. The side walls 62, 63 can be constructed so as to be relatively thick, because they do not affect the overall height of the contacted connector assembly 1, 42. Obviously it is also possible to apply other techniques known per se for retaining a male contact element 44 in housing 60, such as, for example, "press-fit" mounting.

The female contact element 3 shown in FIG. 9 is of the so-called "single beam" type, having a single contact finger in the form of a resilient, elongate, narrow plate part 55, which extends from a base part 57 and with one end is fixed thereto. At its free end, the plate part 55 is provided with a curved contact site 58 in the form of a protuberance projecting from the convex section. In addition, extending from the base part 57 there are a pin-shaped connection end 56 for solder mounting and a backwardly curved resilient lip-shaped member 59 which is raised with respect to the base part 57. In the mounted state of the female contact element 3, said lip-shaped member 59 with its free end engages a wall of the housing, for example a wall of a channel 53. This provides a retention force which is sufficient to prevent spontaneous removal of the contact element 3 from the housing 5, in this case a channel 53 in FIG. 6. Because the contacting direction is transverse to the longitudinal direction of the plate part 55, the lip-shaped member 59 does not have to withstand a plug-in force in the longitudinal direction of the contact element. The female contact element can be inserted with a relatively small mechanical force into a channel 53 of the housing, in order to prevent damage to the plate part 55 by bending or the like. As can be clearly seen from FIG. 9, the width of the plate part 55 is much smaller than its length, this width being the main factor in determining the height of the final connector.

FIG. 10 shows a variation of the female contact element of FIG. 9, in the sense that the contact site 58, in the direction of the contact hole as suggested by the dot-and-dash line 80, is designed to curve away as illustrated by the dot-and-dash line 81. A contact site 58 curved in this way achieves effective mechanical guidance of a male contact element to be contacted, in order to compensate for deviations, caused by tolerances or the like, in the positioning of the contact site 58 with respect to a contact hole 52 in the housing 5 of the female connector 1.

Instead of a plate-shaped contact element 44 as shown in FIG. 8, it is obviously also possible to use a male connector provided with pin-shaped male contact elements in order to contact a female connector according to the invention, as is illustrated in FIG. 11. Here a male connector 42, in cross-sectional view, provided with a U-shaped housing 83 and pin-shaped male contact elements 84, is shown in a contacted state with a female contact element 3 according to FIG. 9. It can be clearly seen that the contact hole extends in the bottom wall of the housing of the female connector, for the purpose of receiving the contact end of the pin-shaped contact element 84, as indicated by the reference number 85. The contact elements 84 are provided with pin-shaped soldering lugs 87, for pin/hole solder mounting in a passage 88 of a substrate 86.

Figure 12C:
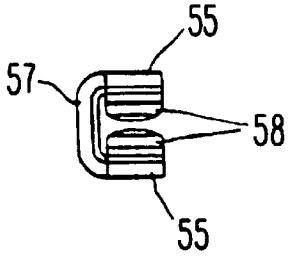
FIGS. 12*a,* 12*b,* 12*c* schematically show a top, side and front view of a female contact element according to a further embodiment for use in a female-type connector according to the invention.
Figure 12A:
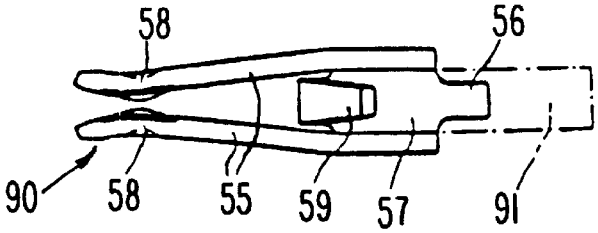

FIGS. 12 *a, b, c* show different views of a female contact element 90 of the so-called "dual beam" type, provided with two parallel, narrow elongate plate parts 15 positioned opposite to one another, corresponding to the female contact element 3 shown in FIG. 9. Instead of a pin-shaped connection end 56, the base part 57 can also be provided with a plate-shaped connection end 91 for surface mounting, as illustrated by broken lines. The connection ends 91 for solder mounting can extend both inside and outside the circumference of the housing 92 (not shown).

Figure 12B:
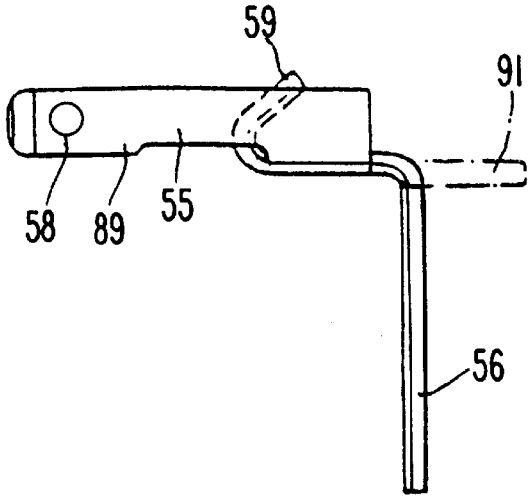
Figure 13:
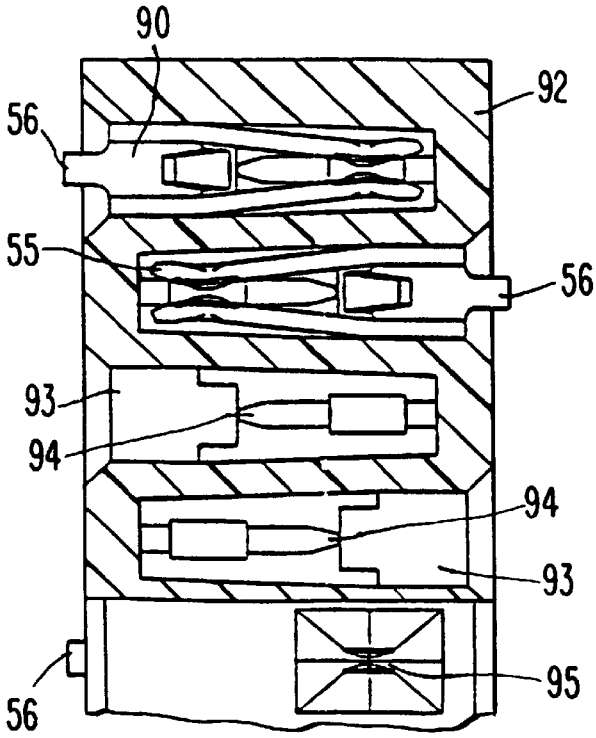
FIG. 13 schematically shows a partly cross-sectional view of a portion of an embodiment of a female-type connector according to the invention, and a printed circuit board equipped with male contact elements for the purpose of contacting the connector.

It can be clearly seen from FIG. 12*b* that the contact fingers 55 are provided near the contact site 58 with an ear-shaped member 89, which in the mounted state of the female contact element 90 engages a stud- or rib-shaped member 94 in a channel 93 of the housing 92, as shown in FIG. 13. The two contact fingers 55, by means of an ear-shaped member 89 of this type and a stud or rib 94, can be kept at a defined position with regard to one another, in order to reduce the force for contacting by a male connector. The stud- or rib-shaped members 94 at the same time serve the purpose of correctly positioning the contact sites of a female contact element with respect to an associated contact hole 95, as shown at the bottom right-hand side in FIG. 13. The contact hole 95 in question is especially suitable for receiving pin-shaped male contact elements 84 as shown in FIG. 11. In contrast to the contact hole 52 shown in FIG. 6, the contact hole 55 does not extend into an adjoining side wall.

The contact elements according to the invention can advantageously be formed as a whole by, for example, punching and subsequent folding from a flat piece of electrically conductive material.

Figure 14:
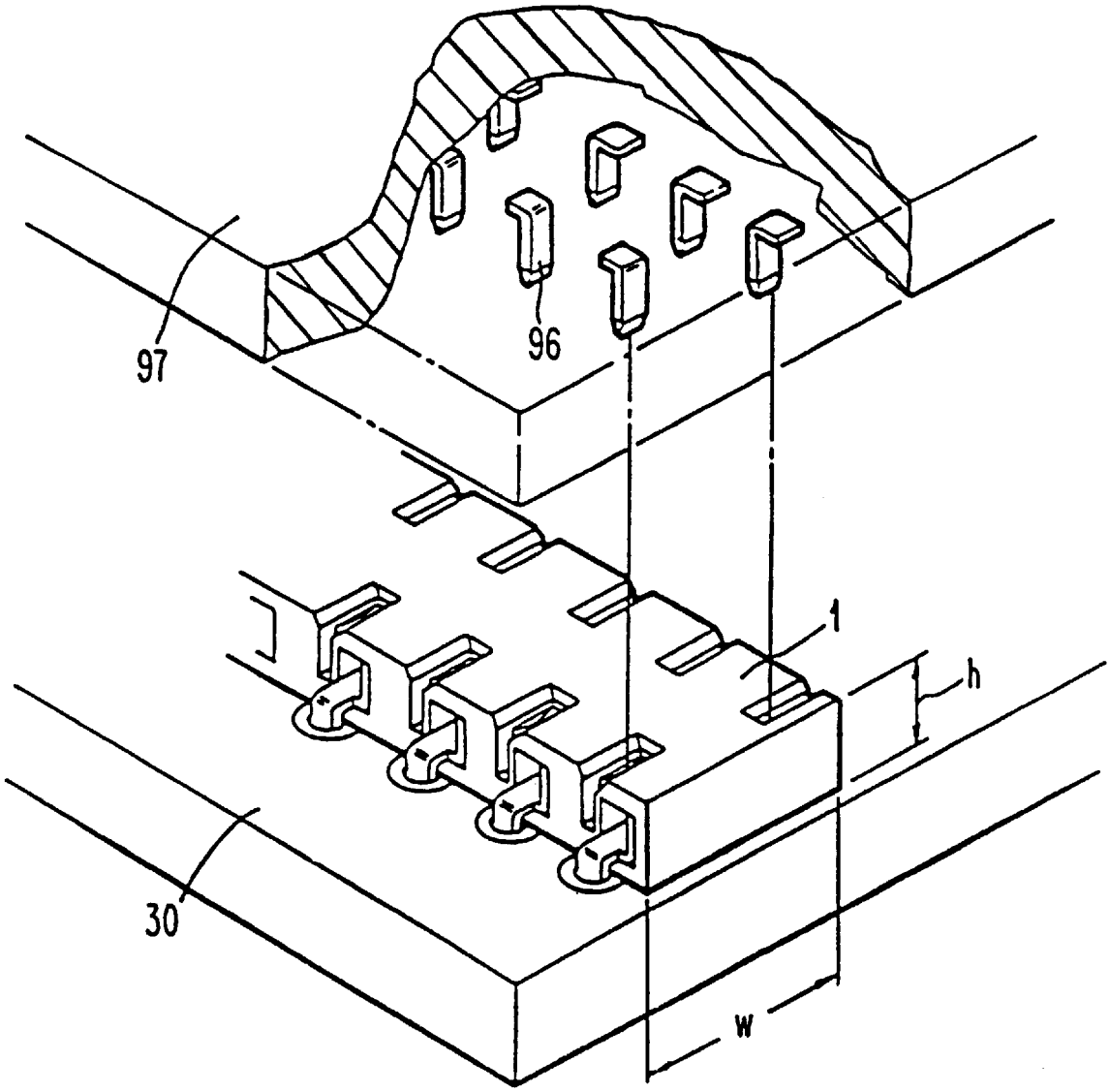
FIG. 14 schematically shows a perspective and partly cross-sectional view of a female-type connector according to the invention, and a printed circuit board equipped with male contact elements for the purpose of contacting the connector.

FIG. 14 shows a further application of the female-type connector according to the invention, for contacting a substrate 97, which is fitted directly with pin-shaped contact elements 96, for example by means of solder surface mounting. Prior to the soldering process, the contact elements 96 been positioned by means of an auxiliary device such as, for example, a removable housing. After soldering, the auxiliary device is removed again. The substrate 97 may also be a single wall, such as the top wall 61 in FIG. 6.

In a practical embodiment, a female connector 1 has been implemented with a height h of 1.6 mm and a width w of 3.5 mm. If female contact elements 3 as shown in FIG. 9 are used, a mutual grid spacing of 0.75 mm can be achieved, while in the case of female contact elements 50 as shown in FIG. 12 a, grid spacings of 1 mm are feasible.

It will be evident that the invention is not limited to the embodiments shown, but that variations and additional features are possible, for example for the purpose of contacting substrates squarely as densely as possible with one another, or for retaining the contact elements by embedding them in the housing by partially encasing them with plastic, if the housing is made of plastic.

What is claimed is:

1. Female-type electrical connector for accepting a male contact element comprising:

a housing made of electrically insulating material having a top wall and a side wall, a contact hole extending along a portion of said top wall and down a portion of said side wall for accepting said male contact element; and a female contact element located in said housing and adjacent to said contact hole for making a contact with said male contact element, said female contact element having a finger-shaped socket contact, said finger-shaped socket contact being parallel to said top wall and substantially extending the width of said housing so as to engage the male contact element when the male contact element extends through the contact hole in the top wall.

2. A low profile connector system, comprising:

a first housing made of electrically insulating material having only a top wall and side walls, a cross section of said first housing forming a reverse U shape;

a male contact element located in said first housing and projecting downwardly from said top wall and perpendicular to said top wall of said first housing;

a second housing made of electrically insulating material having a top wall and a side wall, a contact hole extending along a portion of said top wall and down a portion of said side wall for accepting said male contact element, the width between said side walls of said first housing being larger than the width of said second housing, the height of said second housing being substantially the same as the inside depth of said first housing;

a female contact element located in said second housing and adjacent to said contact hole for making a contact with said male contact element, said female contact element having a finger-shaped socket contact, said finger-shaped socket contact being parallel to said top wall and substantially extending the width of said housing so as to engage the male contact element when the male contact element extends through the contact hole in the top wall;

whereby the total assembled height of said first housing and said second housing is placed within said first housing for making electrical contact between said male contact element and said female contact.

3. A flat high-density female connector for a circuit element, comprising:

a female connector housing having at least a top wall and side walls, said top wall and one of said side walls having an edge, at least one array of holes disposed near said edge such that said holes extend along a portion of said top wall and down a portion of said side walls; and a plurality of female contact elements located inside said female connector housing, each of said female contact elements located near a corresponding one of said holes for exposing an electrical contact surface, each of said female contact elements further comprising:

a lip-shaped portion resiliently engaging said female connector housing for anchoring said female contact element to said female connector housing;

a plate portion arranged perpendicularly to said top wall and substantially extending parallel to said top wall from one of said side walls towards another oppositely located one of said side walls, said plate portion having a first end and a second end, said first end of said plate portion being adjacent to said lip-shaped portion, said second end being free from anchoring and providing a resiliently moving end; and a contact site integral with said second end of said plate portion and positioned perpendicularly to said top wall near said corresponding hole, said contact site resiliently moving and providing said electrical contact surface.

4. The flat high-density female connector according to claim 3 wherein said plate portion further comprises an opposing elongated plate portion.

5. The flat high-density female connector according to claim 4 wherein said contact site further comprises an opposing contact site located at the end of said opposing plate portion.

6. The flat high-density female connector according to claim 3 wherein said female connector housing is a surface-mount on the circuit element.

7. The flat high-density female connector according to claim 3 wherein said female connector housing is through-mounted the circuit element.

8. The flat high-density female connector according to claim 3 wherein said contact site is a curved surface.

9. The flat high-density female connector according to claim 3 wherein said contact site is a protruded surface.

10. The flat high-density female connector according to claim 3 wherein said holes on said top walls extend to a corresponding one of said side walls.

11. The flat high-density female connector according to claim 3 wherein a length of said plate portion is approximately the same as a width of said female connector housing.

12. The flat high-density female connector according to claim 11 wherein said array of said holes substantially extends a length of said female connector housing.

13. A flat high-density female connector for a circuit element, comprising:

a female connector housing having a top wall and two side walls, said top wall and said two walls having two parallel edges along a length of said female connector housing, one array of holes disposed near each of said edges, said holes oppositely located on said parallel edges being positioned in zigzags, a distance between said two side walls defining a width of said female connector housing; and a plurality of female contact elements located inside said female connector housing, each of said female contact elements further comprising:

a lip-shaped portion resiliently engaging said female connector housing for anchoring said female contact element to said female connector housing;

a plate portion arranged perpendicularly to said top wall and substantially extending parallel to said top wall from one of said side walls towards another oppositely located one of said side walls, said plate portion having a first end and a second end, said first end of said plate portion being adjacent to said lip-shaped portion, said second end being free from anchoring and providing a resiliently moving end; and a contact site integral with said second end of said plate portion and positioned perpendicularly to said top wall near said corresponding hole, said contact site resiliently moving and providing said electrical contact surface;

whereby a row of said female contact elements being positioned substantially along each of said edges of said female connector housing so as to expose said contact site through corresponding one of said holes for a maximal density of said female contact elements in said connector housing.

14. A flat high-density connector system for circuit elements, comprising:

a female connector housing having a first top wall and two side walls, said first top wall and said two walls having two parallel edges along a length of said female connector housing, one array of holes disposed near each of said edges, said holes oppositely located on said parallel edges being positioned in zigzags, a distance between said two side walls defining a width of said female connector housing; and a plurality of female contact elements located near said arrays of holes inside said female connector housing, said female contact elements being partially overlapped in a mirror image for a maximal density of said female contact elements in said connector housing, each of said female contact elements further comprising:

a lip-shaped portion resiliently engaging said female connector housing for anchoring said female contact element to said female connector housing;

a plate portion located perpendicularly to said first top wall and substantially extending from one of said side walls towards another oppositely located one of said side walls, said plate portion having a first end and a second end, said first end of said plate portion being adjacent to said lip-shaped portion and anchored to said female connector housing, said second end being free from anchoring and providing a resiliently moving end; and a female contact site integral with said second end of said plate portion and positioned perpendicularly to said first top wall near said corresponding hole, said female contact site resiliently moving and providing said female electrical contact surface;

a male connector housing having at least a second top wall; and a plurality of male contact elements located to correspond said plurality of said female contact elements inside said male connector housing, each of said male contact elements further comprising:

a retention member for anchoring said male contact element to said male connector housing;

a contact end integral to said retention member and positioned transversely to said second top wall for providing a male contact surface; and a tongue distally integral with said contact end from said second top wall for guiding said male contact surface into said corresponding hole in the female connector housing towards said female electrical contact surface, said tongue cleaning said female electrical contact surface by friction.

15. An electrical connector assembly comprising a first connector comprising a first housing, said first connector being connectable to a first substrate, and a second connector comprising a second housing, said second connector being connectable to a second substrate, said connector assembly comprising:

male contact elements having tongue-shaped contact portions, said male contact elements being located in the first connector housing, the first connector housing having a planar upper wall extending generally parallel to the first substrate during use and at least one side wall extending perpendicular to the upper wall, the contact portions of the male contact elements extending perpendicularly to the upper wall and outwardly from the housing such that when the first and second connectors are mated together, the housing of the first connector overlaps with the housing of the second connector with the side walls of the housing of the first connector extending downwardly beyond a planar upper wall of the second housing relative to the second housing; and a plurality of female contact elements located in the second housing, the planar upper wall of the second housing extending generally parallel to the second substrate during use, the upper wall having holes for providing access to the female contact elements, each female contact element having at least one elongate finger adapted to flex in a plane parallel to the upper wall of the housing when engaged with the contact portion of one of the male contact elements of the first connector; whereby the first and second connectors are matable to bring the respective male and female contact elements into operative engagement with the first and second substrates in overlying closely spaced parallel relationship.

16. The connector assembly according to claim 15, wherein the first connector is surface mounted to the first substrate.

17. The connector assembly according to claim 15, wherein the first connector is through mounted in the first substrate.

18. The connector assembly according to claim 15 wherein the second connector is surface mounted to the second substrate.

19. The connector assembly according to claim 15, wherein each female contact element has a pair of elongated fingers adapted to flex toward and away from one another in a plane parallel to the upper wall of the housing of the second connector.

20. The connector assembly according to claim 19, wherein the fingers have inwardly facing contact protuberances.

21. The connector assembly according to claim 15, wherein the male contact elements contact portions for establishing connection with the first substrate.

22. The connector assembly according to claim 15, wherein the female contact elements have contact portions extending outwardly from the connector housing for establishing connection with the second substrate.

23. The connector assembly according to claim 15, wherein the first and second connector housings have interengageable positioning studs and holes.

* * * * *